US005195706A

United States Patent [19]

Allen

[11] Patent Number: 5,195,706

[45] Date of Patent: Mar. 23, 1993

[54] DEVICE FOR HOLDING A CONTAINER UPRIGHT

[76] Inventor: William M. Allen, 204 Cayuga Rd., Louisville, Ky. 40207

[21] Appl. No.: 723,784

[22] Filed: Jul. 1, 1991

Related U.S. Application Data

[63] Continuation-in-part of Ser. No. 328,900, Mar. 27, 1989, Pat. No. 5,028,023.

[51] Int. Cl.[5] ..... A47G 7/00

[52] U.S. Cl. ..... 248/152; 248/174; 206/423

[58] Field of Search ..... 248/152, 311.2, 346, 248/346.1, 150, 146, 174, 300, 519, 523; 206/423, 486, 485, 490, 477, 479

[56] References Cited

U.S. PATENT DOCUMENTS

| | | | |
|---|---|---|---|
| 1,171,210 | 2/1916 | Keffer | 248/152 |
| 1,252,073 | 1/1918 | Achert | 248/174 X |
| 1,487,377 | 3/1924 | Gaynor | 248/152 X |
| 2,030,775 | 2/1936 | Twiss | 248/150 X |
| 2,301,216 | 11/1942 | Koontz | 248/152 |
| 2,865,588 | 12/1958 | McCartney | 248/300 X |
| 3,297,289 | 1/1967 | La Raus | 248/152 |
| 3,481,075 | 12/1969 | Dastoli et al. | 206/423 X |
| 4,088,294 | 5/1978 | Aliment et al. | 248/519 |
| 4,678,149 | 7/1987 | Chase | 248/152 X |
| 4,848,711 | 7/1989 | Mandel | 248/346 X |
| 5,060,798 | 10/1991 | Braastad | 248/152 X |

*Primary Examiner*—Karen J. Chotkowski
*Attorney, Agent, or Firm*—Jon C. Winger

[57] ABSTRACT

A device for holding a container in an upright position includes a base panel upon which the container rests and container anchoring flanges interconnected to the base panel which surround to the container above the base panel to hold the container in place on the base panel.

20 Claims, 4 Drawing Sheets

DEVICE FOR HOLDING A CONTAINER UPRIGHT

CROSS-REFERENCE TO RELATED APPLICATION

This is a continuation-in-part of application Ser. No. 07/328,900, filed Mar. 27, 1989 now U.S. Pat. No. 5,028,023.

BACKGROUND OF THE INVENTION

The present invention relates to holders for containers for flowers and plants such as flower vases and pots which is particularly useful for supporting these containers during transportation from one place to another.

Florists sell flowers and plants both directly to customers so that the customers can take their purchase with them, and also deliver the flowers and plants to wherever the customer designates.

The problem is that during transporation, either by the customer or florist, it often happens that the flower vase or pot easily tips over spilling the contents.

One known attempted solution to this problem is to place the containers in a box. However, boxes are not specially designed for the purpose of transporting such containers and do not hold the container upright. The containers can and do still fall over and the contents are spilled inside the box. Furthermore, boxes take up substantial volume and, therefore, present a storage problem because they occupy valuable space in the florist's business facility.

Another problem also exists at the destination of the containers, such as hospitals, which receive many containers of flowers and plants for patients which must then be delivered to the various patients. This is often done on push carts and the containers are easily tipped over spilling the contents which must be cleaned up.

Various other solutions have been proposed. Examples of these proposed solutions are shown in U.S. Pat. No. 2,063,328 issued on Dec. 89, 1936; U.S. Pat. No. 2,784,577 issued on Mar. 12, 1957; U.S. Pat. No. 2,980,377 issued on Apr. 18, 1961; U.S. Pat. No. 3,297,289 issuesd on Jan. 10, 1967; and U.S. Pat. No. 4,726,553 issued on Feb. 23, 1988.

However, each of these proposed solutions has itself major drawbacks. For example, each of these proposals is of a fixed size and accept only one size container. This drawback requires an inventory of such holders of various sizes.

A further drawback of the containers shown in U.S. Pat. No. 2,784,577; U.S. Pat. No. 2,980,377; and U.S. Pat. No. 4,726,553 is that they are of a physical configuration which requires a substantial space when stored.

SUMMARY OF THE INVENTION

An object of the present invention is to provide a device for holding a container upright which is adaptable to hold containers of various sizes thereby reducing or eliminating the requirement for inventoring holders of various sizes.

It is another object of the present invention which, when not used to hold containers, is substantially flat or planar for compact storage thereby freeing up room otherwise required for storage.

It is a further object of the present invention to provide a holder which is of straightforward construction and, therefore, inexpensive to purchase, so that a vendor of the flowers or other contents of the containers can afford to give them away with the purchase of the flowers as a service to the purchaser.

It is yet another object of the present invention to provide a container holding device which mechanically, positively engages the container to hold the container downwardly against the base of the container holding device.

BRIEF DESCRIPTION OF THE DRAWINGS

A better understanding of the invention will be had upon reference to the following description in conjunction with the accompanying drawings wherein like numerals refer to like parts through the several views and in which.

DETAILED DESCRIPTION OF THE PREFERRED EMBODIMENTS

Figure 1:
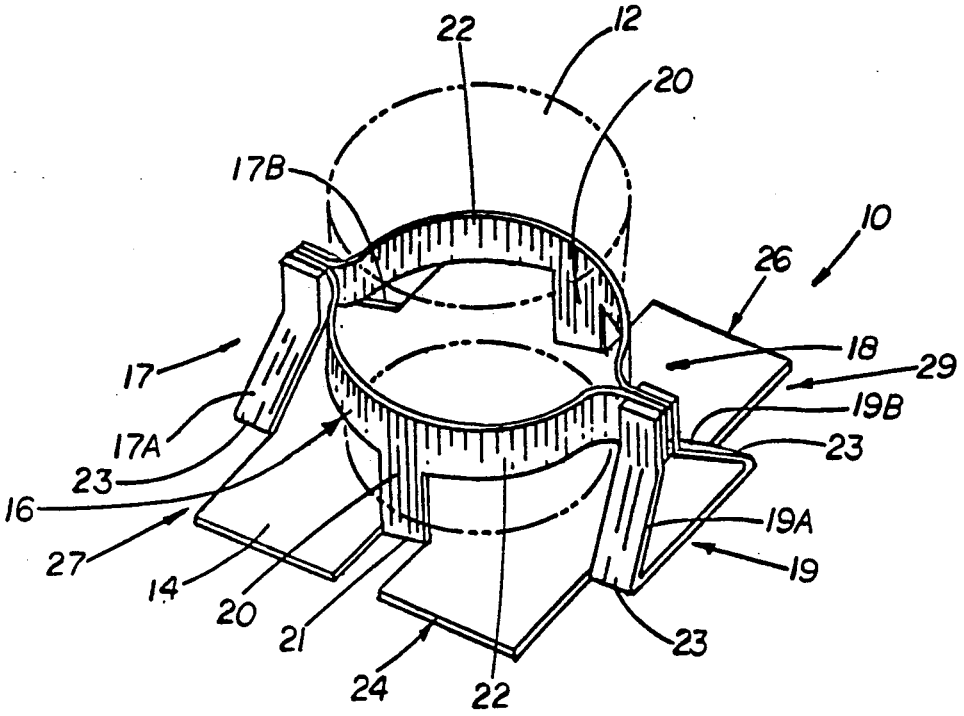
FIG. 1 shows a perspective view of an advantageous embodiment of a container holder of the present invention holding a container such as a flower pot or vase.
Figure 2:
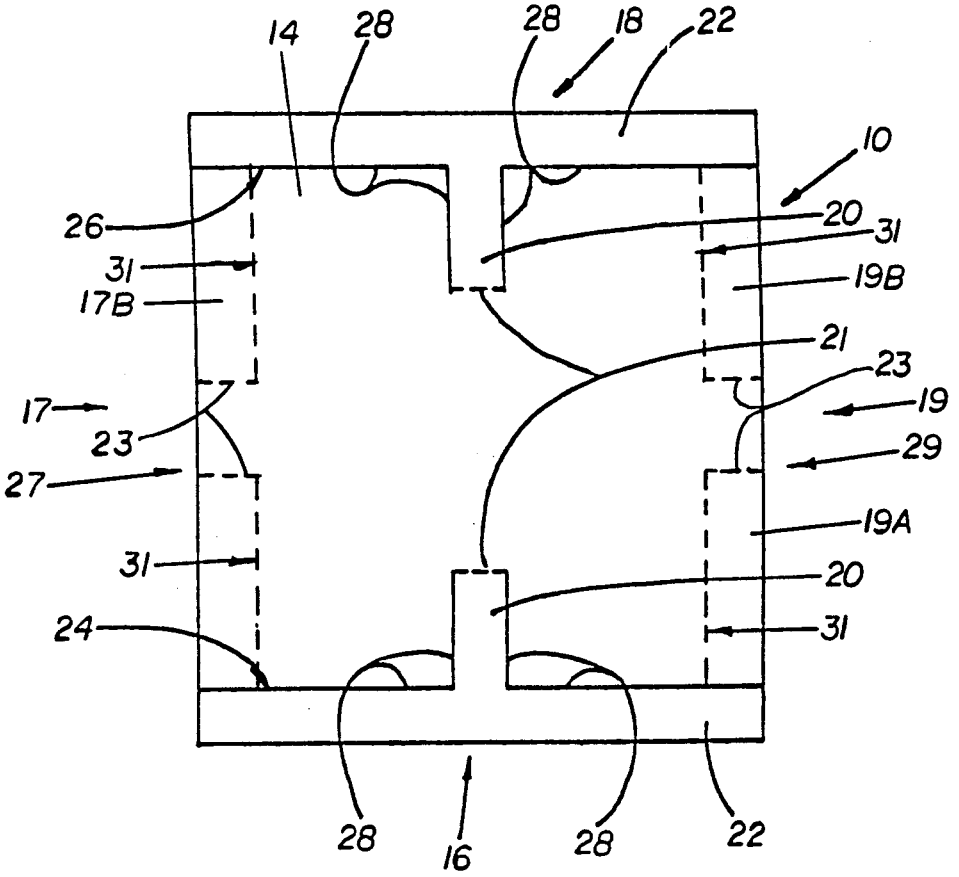
FIG. 2 shows a plan view of the holder of FIG. 1 in its unfolded configuration suitable for storage.

With reference to FIGS. 1 and 2, there is shown a device, generally denoted as the numeral 10, for holding a container 12 (shown in phantom lines) such as, for example, a flower vase or pot, upright.

The holder device 10 includes a base panel 14 upon which the base of the container 12 rests. As shown, the base panel 14 is preferably rectangular in peripheral configuration although it is conceivable that other peripheral configurations can be used. The holder device 10 further includes two anchoring flanges 16 and 18 disposed to opposite parallel first and second sides 24 and 26, respectively, of the base panel 14 and in alignment with each other, and two sets 17 and 19 of reinforcement stems disposed to opposite parallel third and fourth sides 27 and 29, respectively, of the base panel and in alignment with each other. The first and second sides 24, 26 of the panel 14 are generally perpendicular to the third and fourth sides 27, 29 of the panel 14. The anchoring flanges 16, 18 are each Tee-shaped with a stem 20 integrally connected at its bottom or proximal end to the base panel 14 and a cross arm 22 extending outwardly from both longitudinal edges of the stem 20 at the top or distal end of the stem 20. The Tee-shaped anchoring flanges 16 and 18 are foldable relative to the base panel 14 about the integral interface of the stem 20 with the base panel 14. A score or crease line 21 can be formed transversely of the stem 20 so that the stem 20 can be easily folded about the score line 21. The reinforcement stem set 17 consists of a pair of reinforcement stems 17*a* and 17*b*, each integrally connected at its bottom or proximal end to the base panel 14, and the reinforcement stem set 19 consists of a pair of reinforcement stems 19*a* and 19*b*, each integrally connected at its bottom or proximal end to the base panel 14. The stems 17*a*, 17*b*, 19*a*, 19*b* are foldable relative to the base panel 14 about the integral interface of the stem with the base panel 14. A score or crease line 23 can be formed transversely of each reinforcement stem 17*a*, 17*b*, 19*a*, 19*b* at its proximal so that each reinforcement stem can be easily folded about the score line 23.

As can be seen in FIG. 2, when in a preassembled state and not in use supporting a container 12, the holder 10 is unfolded and in a planar configuration. In the preassembled state in an unfolded configuration, the Tee-shaped anchoring flanges 16 and 18 are coplanar with the base panel 14 and the reinforcement stems 17*a*, 17*b*, 19*a*, 19*b* are also coplanar with the base panel 14. The arms 22 of the two anchoring flanges 16 and 18 extend along the opposite first and second sides 24 and 26, respectively, of the base panel 14, and the stems 20 of the two anchoring flanges 16 and 18 extend inwardly of the base panel 14 perpendicularly from the opposite base panel side edges 24 and 26 in coaxial alignment with each other. The proximal ends of the reinforcement stems 17*a* and 17*b* of the set 17 of reinforcement stems are spaced apart from each other to opposite sides of the center of the third side 27 of the panel 14 with the stems 17*a* and 17*b* in mutual longitudinal alignment and extending along the third side edge 27 of the panel in opposite directions. The proximal ends of the reinforcement stems 19*a* and 19*b* of the set 19 of reinforcement stems are spaced apart from each other to opposite sides of the center of the fourth side 29 of the panel 14 with the stems 19*a* and 19*b* in mutual longitudinal alignment and extending along the fourth side edge 29 of the panel in opposite directions. The distal ends of the reinforcement stems 17*a* and 19*a* are in close proximity to or abut the bottom edge of the cross arm 22 of the anchoring flange 16 proximate the opposite distal ends thereof, and the distal ends of the reinforcement stems 17*b* and 19*b* are in close proximity to or abut the bottom edge of the cross arm 22 of the anchoring flange 18 proximate the opposite distal ends thereof. The length of each of the reinforcement stems 17*a*, 17*b*, 19*a*, 19*b* measured from its proximal end to its distal end is at least as long as the length of the anchoring flanges 16, 18 measured from the proximal end of the stem 20 to the top edge of the cross arm 22.

As can be best visualized in FIG. 2, it is contemplated that the holder device 10 can be fabricated from a single blank of material, such as paperboard, corrugated board, plastic, or other suitably stiff material. The material of the holder 10 can be of the type which is at least somewhat absorbent, but will not disintegrate when wet. The material of the holder 10 can also be waterproof or water repellent, such as a waxed paperboard or plastic. The Tee-shaped anchoring flanges 16 and 18 are cut in the material blank along cut lines 28 which define the peripheral configuration of the two Tee-shaped flanges 16 and 18 and sever the Tee-shaped flanges 16 and 18 from the material blank. The reinforcement stems 17*a*, 17*b*, 19*a*, 19*b* are cut in the material blank along cut lines 31.

With reference to FIGS. 1 and 2, in an assembled state holding a container upright, the container 12 is positioned with its bottom or base resting on the base panel 14 between the proximal ends of the stem 20 of the two anchoring flanges 16 and 18. The two anchoring flanges 16 and 18 are folded about the interface of their respective stems 20 with the base panel 14 so that the stems 20 extend upwardly along opposite sides of the container 12 with the arms 22 extending transversely of the container in registration with each other. The free or distal ends of the arm 22 of the anchoring flange 16 are then brought together in overlapping relationship with and attached to the adjacent free or distal ends of the arm 22 of the other anchoring flange 18 thereby forming a collar surrounding the container 12. The distal ends of the arms 22 of the anchoring flanges 16 and 18 can be fastened together by virtually any convenient fastener means such as, for example, taping them together or stapling them together. Preferably, the collar formed by the arms 22 of the anchoring flanges 16 and 18 tightly encompasses the container 12, holding the container 12 upright on the panel 14. To increase the stability of anchoring flanges 16 and 18 holding the container, the two reinforcement stems 17*a* and 17*b* are folded about their respective crease lines 23 at their respective proximal ends so the reinforcement stems 17*a* and 17*b* extend upwardly in registration with each other. The free or distal ends of the stems 17*a* and 17*b* are positioned in abutting overlapping relationship with one end of the assembly of overlapped adjacent distal ends of the arms 22 of the anchoring flanges 16 and 18 to opposite sides thereof, and are fastened thereto by, for example, staples. The two reinforcement stems 19*a* and 19*b* are folded about their respective crease lines 23 at their respective proximal ends so the reinforcement stems 19*a* and 19*b* are positioned in abutting overlapping relationship with the other end of the assembly of overlapped adjacent distal ends of the arms 22 of the anchoring flanges 16 and 18 to opposite sides thereof, and are fastened thereto by, for example, staples.

The anchoring flanges 16, 18 can be easily modified by the user to support short containers by merely folding the extending arms 22 back over the stem 20 transversely of the stem 20 thereby effectively shortening the length of the stem 20. It is contemplated that the cut lines 28 defining the opposite longitudinal sides of the stem 20 can be continuous severing the Tee-shaped anchoring flanges 16 and 18 from the blank, or discontinuous thereby leaving webs of uncut material at preselected intervals along the length of the cross arm 22 and stem 20, thus keeping cross arms and stems coplanar with panel 14 until used. In addition, the user can select the length of the stem 20 to suit the height of a particular container by severing the stem 20 from the bank to a location of a web corresponding to a stem length which will position the arms 22 of the anchoring flanges 16, 18 beneath the top end of the container to be held in position on the container holding device 10. It is also contemplated that the cut lines 31 defining the reinforcement stems 17*a*, 17*b*, 19*a*, 19*b* can be continuous severing the reinforcement stems from the material blank or discontinuous along the entire length of the reinforcement stems thereby leaving webs of uncut material at preselected intervals along the length of the reinforcement stems. Thus, the user can select either the length of the reinforcement stems 17*a*, 17*b*, 19*a*, 19*b* to suit the height of a particular container by severing the reinforcement stems from the blank to a location of a web corresponding to a location of the cross arms 22 of the anchoring flanges 16, 18, or to leave the reinforcement stems 17*a*, 17*b*, 19*a*, 19*b* attached to and coplanar with the panel 14.

It should be noted that when the holder 10 is in the unfolded flat configuration shown in FIG. 2, that a plurality of holders 10 can be placed in a stack which requires very little storage space.

The holder device 10 can be made in a single size which will function to hold containers 12 of many various circumferential dimensions and shapes as well as containers 12 of different heights. This versatility is provided for by the feature that the distal adjacent ends of the arms 22 of the anchoring flanges 16 and 18 can be overlapped with each other to a greater or lesser extent before they are fastened together thereby defining a collar of a suitable perimeter dimension to encompass different circumferentially sized containers 12.

Figure 3:
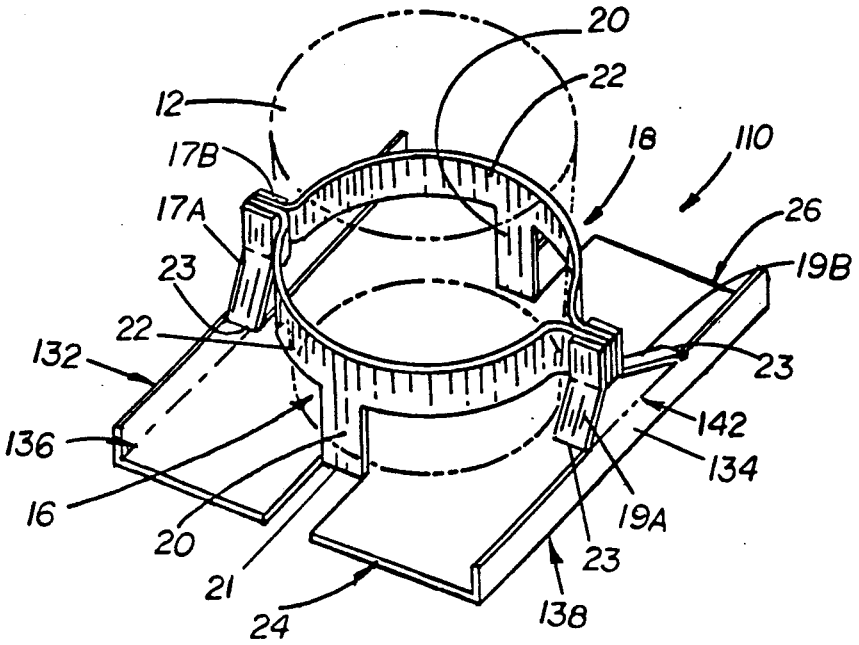
FIG. 3 shows a perspective view of another advantageous embodiment of a container holder of the present invention.
Figure 4:
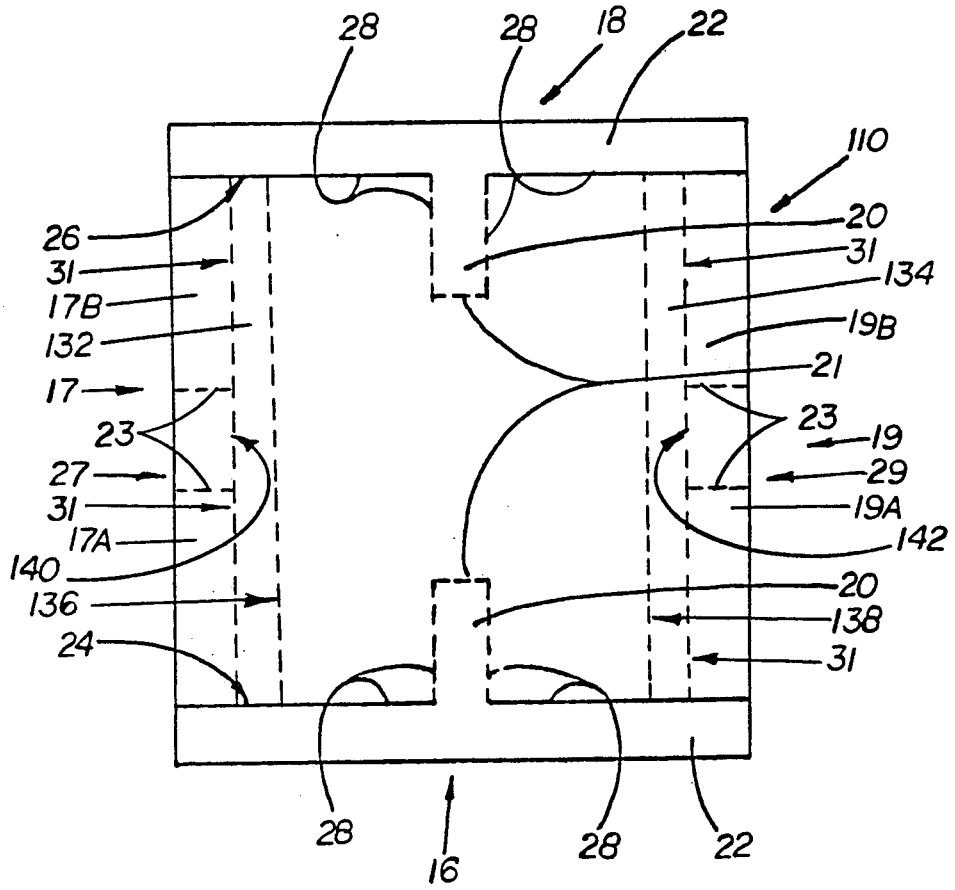
FIG. 4 shows a plan view of the holder of FIG. 3 in its unfolded configuration suitable for storage.

With reference to FIGS. 3 and 4, there is shown a container holder 110 for holding a container 12 upright which has many features in common with the container holder 10 of FIGS. 1 and 2. For the sake of brevity, the common features are denoted by identical numerals and the description thereof will not be repeated. In addition to the two anchoring flanges 16 and 18 and the reinforcement stems 17*a*, 17*b*, 19*a*, 19*b* in common with the container holder 10, the container holder 110 further comprises a pair of panel reinforcement side flanges 132 and 134 integrally, and foldably, connected to the base panel 14. The reinforcement side flange 132 is formed in the panel 14 by a fold line 136 parallel to the third side 27 of the panel 14 so that the reinforcement side flange 132 extends entirely along the third side 27 of the panel 14. The reinforcement side flange 134 is formed in the panel 14 by a fold line 138 parallel to the fourth side 29 of the panel 14 so that the reinforcement side flange 134 extends entirely along the fourth side 29 of the panel 14. The reinforcement stems 17*a* and 17*b* are integrally connected at their bottom or proximal ends to the panel reinforcement side flange 132 at the free edge thereof and the reinforcement stems 19*a* and 19*b* are integrally connected at their bottom or proximal ends to the panel reinforcement side flange 134 at the free edge thereof. A score or crease line 23 can be formed transversely of each reinforcement stem 17*a*, 17*b*, 19*a*, 19*b* at its proximal end so that each reinforcement stem 17*a*, 17*b*, 19*a*, 19*b* can be easily folded about the score line 23 associated therewith. A score or crease line 140 can be formed along the integral connection of the stems 17*a* and 17*b* to the side reinforcement flange 132 extending between the transverse score lines 23 of the reinforcement stems 17*a* and 17*b* in alignment with the side edge of the side reinforcement flange 132. Similarly, a score or crease line 142 can be formed along the integral connection of the stems 19*a* and 19*b* to the reinforcement stems 19*a* and 19*b* in alignment with the side edge of the side reinforcement flange 134.

As can be seen in FIG. 4, when in a preassembled state or prior to assembly and not in use supporting a container 12, the holder 110 is unfolded and in a planar configuration. In the unfolded configuration, the two anchoring flanges 16 and 18, the reinforcement stems 17*a*, 17*b*, 19*a* and 19*b*, the reinforcement side flanges 132 and 134, and panel 14 are all coplanar.

As can be best visualized in FIG. 4, it is contemplated that the holder device 110 be fabricated from a single blank of material, such as paperboard, corrugated board, plastic, or other suitably stiff material. The material of the holder 110 can be of the type which is at least somewhat absorbent, but will not disintegrate when wet. The material of the holder 110 can also be waterproof or water repellent, such as a waxed paperboard or plastic. The Tee-shaped anchoring flanges 16 and 18 are cut in the material blank along cut lines 28 which define the peripheral configuration of the two Tee-shaped flanges 16 and 18. It is contemplated that the cut lines 28 can be continuous severing the Tee-shaped flanges 16 and 18 from the material blank or discontinuous thereby leaving webs of uncut material at preselected intervals along the stem 20. The reinforcement stems 17*a*, 17*b*, 19*a*, 19*b* are cut in the material blank along cut lines 31. It is contemplated that the cut lines 31 can be continuous severing the reinforcement stems 17*a*, 17*b*, 19*a*, 19*b* from the blank, or discontinuous leaving webs of uncut material at preselected intervals along the length of the reinforcement stems 17*a*, 17*b*, 19*a*, 19*b*. Thus, the user can select either to use the reinforcement stems 17*a*, 17*b*, 19*a*, 19*b* to reinforce the anchoring flanges 16, 18 or to leave the reinforcement stems 17*a*, 17*b*, 19*a*, 19*b* attached to and coplanar with the side reinforcement flanges 132, 134. The reinforcement side flanges 132 and 134 are formed by fold lines 136 and 138 made in the material blank.

With reference to FIGS. 3 and 4 in the assembled state holding a container upright, the container 12 is positioned with its bottom or base resting on the base panel 14 between the proximal ends of the stem 20 of the two anchoring flanges 16 and 18. The two anchoring flanges 16 and 18 are folded about the interface of their respective stems 20 with the base panel 14 so that the stems 20 extend upwardly along opposite sides of the container 12 with the arms 22 extending transversely of the container in registration with each other. The free or distal ends of the arm 22 of the anchoring flange 16 are then brought together in overlapping relationship with and attached to the adjacent free or distal ends of the arm 22 of the other anchoring flange 18 thereby forming a collar surrounding the container 12, The distal ends of the arms 22 of the anchoring flanges 16 and 18 can be fastened together by virtually any convenient fastener means such as, for example, taping them together or stapling them together. Preferably, the collar formed by the arms 22 of the anchoring flanges 16 and 18 tightly encompass the container 12 holding the container 12 upright on the panel 14. To increase the stability of the anchoring flanges 16 and 18 holding the container and the panel 14, the two panel reinforcement side flanges 132 and 134 are folded upwardy about their fold lines 136 and 138, respectively, to project upwardly from the panel 14. The stems 17*a* and 17*b* are jointly folded downwardly from the upstanding side flange 132 about the crease line 140, and the stems 19*a* and 19*b* are jointly folded downwardly from the upstanding side flange 134 about the crease line 142. The two reinforcement stems 17*a* and 17*b* are then folded about their respective crease lines 23 at their respective proximal ends so that the reinforcement stems 17*a* and 17*b* extend upwardly from the free edge of the upstanding reinforcement side flange 132 in registration with each other. The free or distal ends of the stems 17*a* and 17*b* are positioned in abutting overlapping relationship with one end of the assembly of overlapped adjacent distal ends of the arms 22 of the anchoring flanges 16 and 18 to opposite sides thereof, and are fastened thereto by, for example, staples. The two reinforcement stems 19*a* and 19*b* are then folded about their respective crease lines 23 at their respective proximal ends so that the reinforcement stems 19*a* and 19*b* extend upwardly from the free edge of the upstanding reinforcement side flange 134 in registration with each other. The free or distal ends of the stems 19*a* and 19*b* are positioned in abutting overlapping relationship with the other end of the assembly of overlapped adjacent distal ends of the arms 22 of the anchoring flanges 16 and 18 to opposite sides thereof, and are fastened thereto by, for example, staples. The stems 17*a*, 17*b*, 19*a*, 19*b* stabilize the anchoring flanges 16 and 18, and the reinforcement side flanges 132 and 134 stabilize the panel 14 against flexing, bending or warping.

Figure 5:
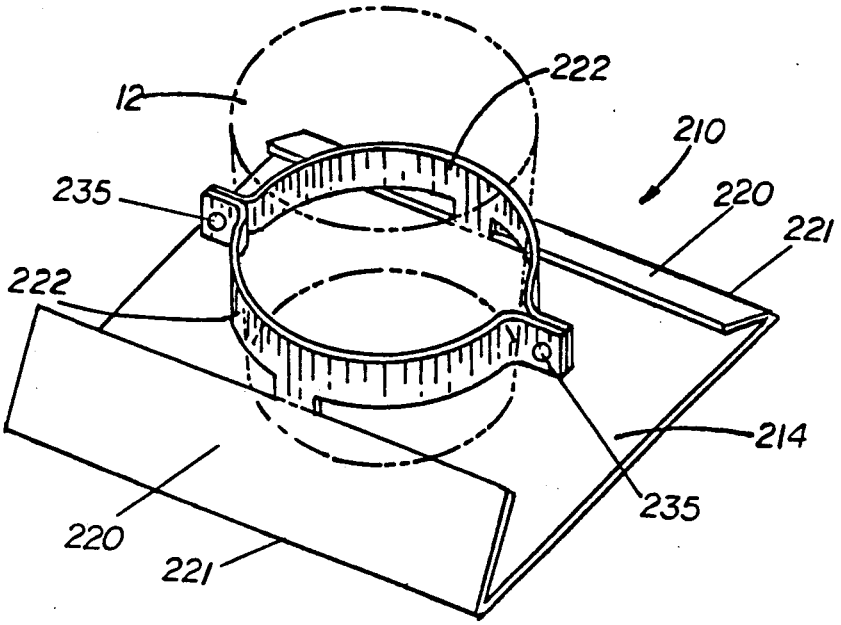
FIG. 5 shows a perspective view of yet another advantageous embodiment of a container holder of the present invention.
Figure 6:
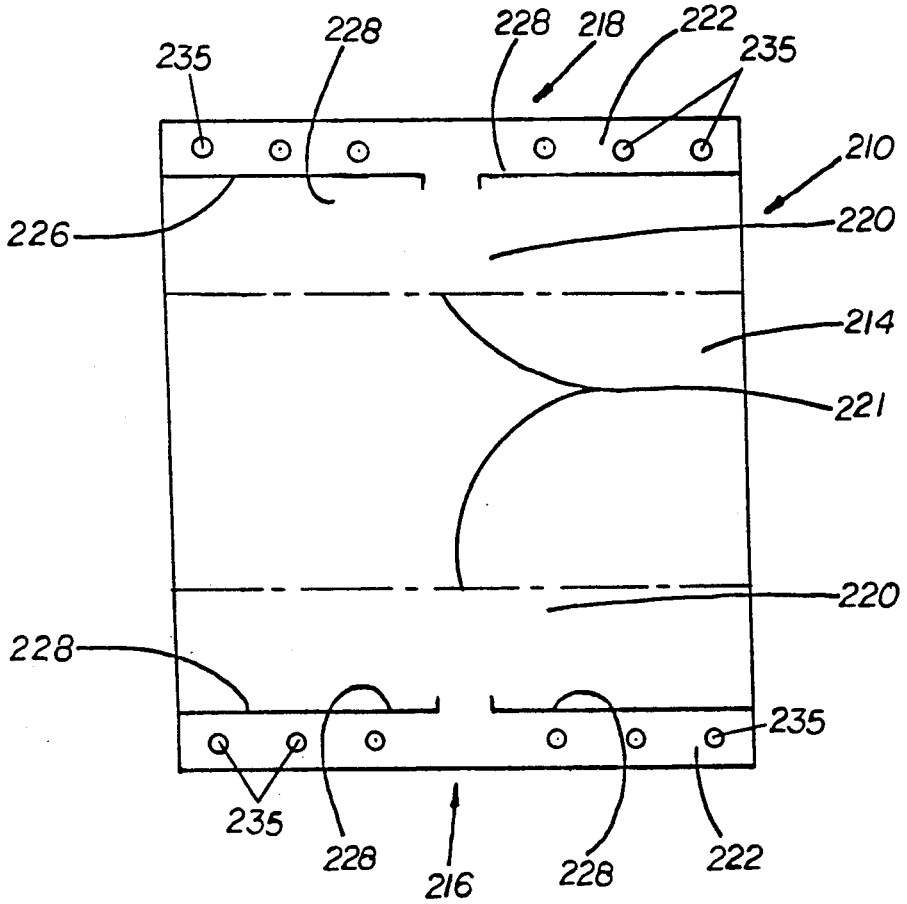
FIG. 6 shows a plan view of holder of FIG. 5 in its unfolded configuration suitable for storage.

In FIGS. 5 and 6 there is shown a device, generally denoted as the numeral 210, for holding a container 12 such as, for example, a flower vase or pot, upright.

The holder 210 includes a base panel 214 upon which the base of the container 12 rests. As shown, the base panel 214 is preferably rectangular in peripheral configuration. The holder 210 further includes two anchoring flanges 216 and 218 disposed to opposite sides of the base panel 214 and in alignment with each other. Each anchoring flange 216 and 218 includes a stem panel 220 integrally attached at its bottom or proximal end to an edge of the base panel 214. The stem panels 220 are defined by and foldable about crease lines or score lines 221 formed in the base panel 214 parallel to opposite sides of the base panel and extending across the base panel so that the anchoring flanges are coextensive in width to the width of the base panel. The crease lines 221 are the proximal ends of the anchoring flanges 216 and 218. Each anchoring flange 216 and 218 also includes a cross arm 222 integrally attached at its longitudinal center to the top or distal edge of the stem panel 220. Each cross arm 222 is coextensive in length with the width of the base panel 214. Each cross arm 222 is foldable about the integral interface with the stem panel 220.

As can be seen in FIG. 6, when not in use supporting a container 12, the holder 210 is unfolded and in a planar configuration with the cross arms 222 coplanar with the stem panels 220 along the distal edges thereof, and with the stem panels 220 coplanar with the base panel 214.

It is contemplated that the holder device 210 be fabricated from a single blank of material, such as paperboard, corrugated board, plastic, or other suitably stiff material. The material of the holder device 210 can be of the type which is at least somewhat absorbent but will not disintegrate when wet. The material of the holder device 210 can also be waterproof or water repellent, such as a waxed paperboard, or plastic. The cross arms 222 are cut in the stem panels 220 of the material blank along cut lines 228 which define the peripheral configuration of the two cross arms 222. The cut lines 228 can be continuous or discontinuous as discussed above in regard to the holder devices of FIGS. 1, 2, 3, and 4.

With continued reference to FIGS. 5 and 6, in order to hold a container 12 upright, the container 12 is positioned with its bottom or base resting on the base panel 214 between the stem panels 220 of the two anchoring flanges 216 and 218. The stem panels 220 are each folded about their interface with the base panel 214 so that the stem panels 220 extend upwardly to opposite sides of the container 12 with the cross arms 222 extending transversely of the container 12 in registration with each other. The free or distal ends of the cross arm 222 of the anchoring flange 216 are then brought together in overlapping relationship with and attached to the adjacent free or distal ends of the cross arm 222 of the other anchoring flange 218 thereby forming a collar surrounding the container 12. The free or distal ends of the cross arms 222 of the anchoring flanges 216 and 218 can be fastened together by virtually any convenient fastener means such as, for example, taping them together or stapling them together. However, as shown best in FIG. 6, the cross arm 222 of each of the two anchoring flanges 216 and 218 is formed with a plurality of holes 235 spaced apart along the length of the cross arm 222. In order to fasten the cross arms 222 of the anchoring flange 216 to the cross arm 222 of the anchoring flange 218, a short length of, for example, a wire tie (not shown) is inserted through the holes 235 on the cross arm 222 of the anchoring flange 216 in registration with the holes 235 of the cross arm 222 of the anchoring flange 218 and the extending portion of the wire tie are twisted together. Preferably, the collar formed by the cross arms 222 of the anchoring flanges 216 and 218 tightly encompass the container 12.

Figure 7:
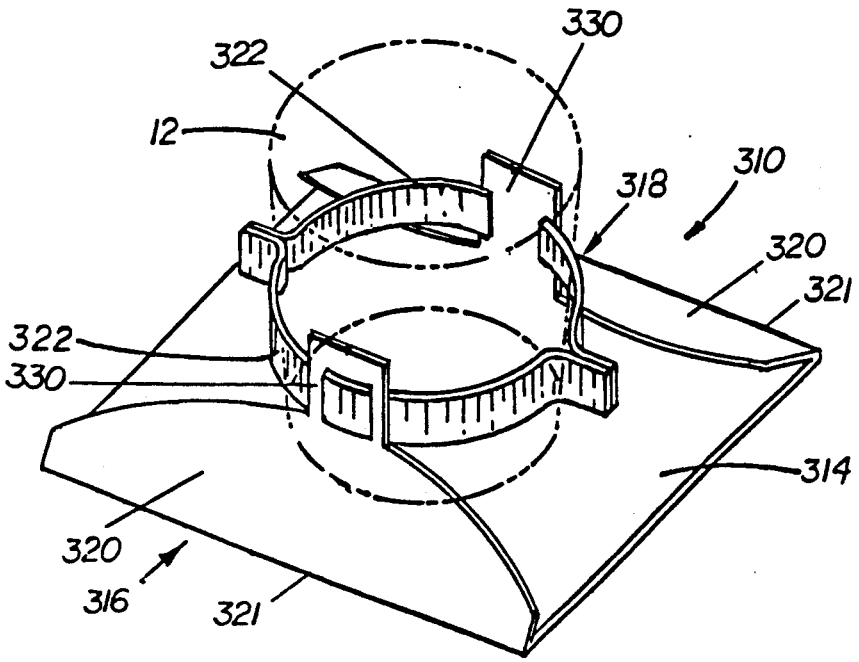
FIG. 7 shows a perspective view of still another advantageous embodiment of a container hodler of the present invention; and, FIG. 8 shows a plan view of the holder of FIG. 7 in its unfolded configuration suitable for storage.
Figure 8:
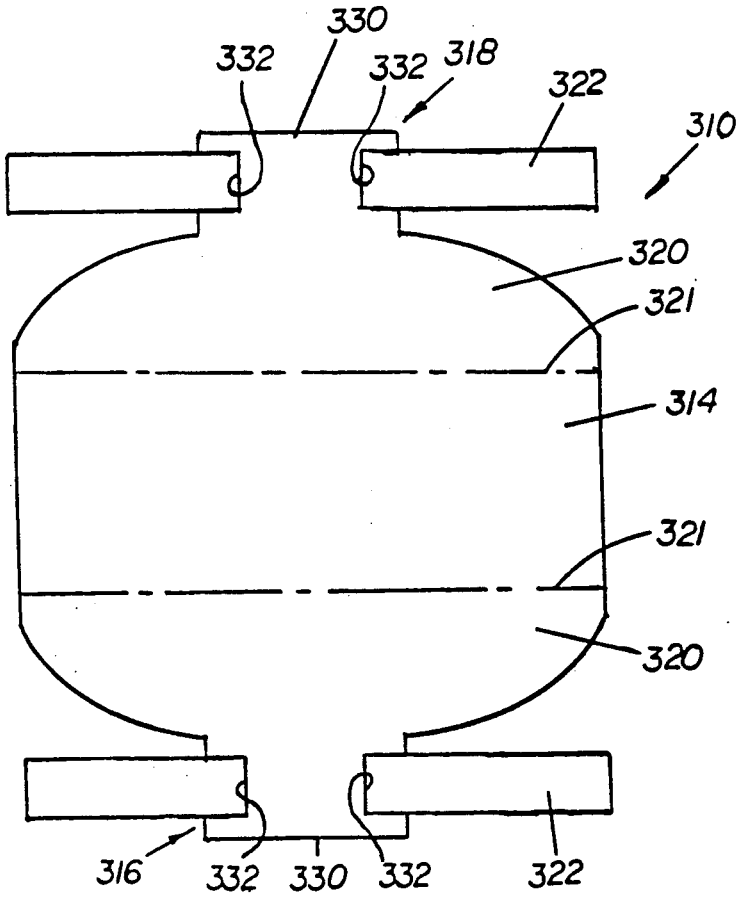

Now with reference to FIGS. 7 and 8, there is shown a device, generally denoted as the numeral 310, for holding a container 12 upright.

The holder 310 includes a base panel 314 upon which the base of the container rests. As shown, the base panel 314 is preferably rectangular in peripheral configuration. The holder 310 further includes two anchoring flanges 316 and 318 disposed to opposite sides of the base panel 314 and in alignment with each other. Each anchoring flange 316 and 318 includes a stem panel 320 integrally attached at its bottom or proximal end to an edge of the base panel 314. The stem panels 320 are foldable about the integral interface of the stem panel 320 with the base panel 314. A crease line 321 can be formed at the interface of the stem panels 320 and the base panel 314 to provide a straight fold. Each anchoring flange 316 and 318 also includes a cross arm 322. Each cross arm 322 consists of a flexible strap centered on and attached between its ends to the center of the top or distal edge of the stem panel 320. As shown, each stem panel 320 is formed with an integral first strap attachment fixture 330 positioned at the center of the top or distal edge of the stem panel 320 and coplanar with the stem panel. Each flat strap attachment fixture 330 is formed with two spaced-apart, parallel, strap-receiving slots 332 perpendicular to the crease line 321 at the interface of the stem panels 320 and base panel 314. The cross straps 322 are threaded through the strap-receiving slots 332 to extend from opposite sides of the attachment fixture 330, thereby attaching the cross straps 322 to the stem panels 320. The adjacent ends of the cross straps 322 can be fastened together forming a collar surrounding the container 12 by various fastening means. For example, the adjacent ends of the cross straps 322 can be stapled together or even tied together. However, in a preferred embodiment of the cross straps 322, each cross arm or strap 322 includes the different complementary half of a hook and eye fastener so that the cross straps can be removable fastened together.

As can be best seen in FIG. 8, when not in use supporting a container 12, the holder 310 is unfolded and in a planar configuration with the stem panels 320 coplanar with the base panel 314 and with the cross straps 322 either removed from the attachment fixture 330, or as shown with the cross straps 322 laid flat extending from the attachment fixture 330.

With continued reference to FIGS. 7 and 8, in order to hold a container 12 upright, the container 12 is positioned with its bottom or base resting on the base panel 314 between the stem panels 320 of the two anchoring flanges 316 and 318. The stem panels 320 are each folded about their interface with the base panel 314 so that the stem panels 320 extend upwardly to opposite sides of the container 12 with the cross straps 322 extending transversely of the container 12 in registration with each other. The free or distal ends of the cross strap 322 of the anchoring flange 316 are then brought together in overlapping relationship with and are attached to the adjacent free or distal ends of the cross strap 322 of the other anchoring flange 318 by stapling the adjacent overlapped ends together, tying the adjacent ends togehter, or by the cooperation of the complementary hook and eye fasten portions of the straps 322, thereby forming a collar surrounding the container 12.

The foregoing detailed description is given primarily for clearness of understanding and no unnecessary limitations are to be understood therefrom for modifications will become obvious to those skilled in the art and may be made without departing from the spirit of the invention and scope of the appended claims.

I claim:

1. A device for holding a container upright, the device when in a preassembled state, comprising:

a base panel having generally parallel first and second sides, and generally parallel third and fourth sides generally perpendicular to the first and second sides, upon which the bottom of the container to be held will rest;

a pair of Tee-shaped anchoring flanges, each Tee-shaped anchoring flange having a stem integrally connected at a proximal end of the stem to the base panel and a cross arm integral with and extending outwardly from a distal end of the stem, the Tee-shaped anchoring flanges being coplanar with the base panel with the cross arms of the two anchoring flanges being adjacent to and extending along opposite first and second sides of the base panel and the stems of the two anchoring flanges extending inwardly of the base panel from the arms of the anchoring flanges; and, two sets of reinforcement stems being integrally connected and coplanar with the base panel and disposed adjacent to opposite third and fourth sides of the base panel.

2. The device of claim 1, wherein the stems of the two anchoring flanges of the pair of anchoring flanges are in coaxial alignment with each other.

3. The device of claim 1, wherein the arms of the two anchoring flanges of the pair of anchoring flanges are coextensive with an adjacent side of the base panel.

4. The device of claim 1, wherein each set of reinforcement stems comprises a pair of stems each integrally connected at its proximal end to the base panel, the stems of each set being in mutual longitudinal alignment and extending along the adjacent side of the base panel.

5. The device of claim 4, wherein the proximal ends of the reinforcement stems of each set of reinforcement stems are spaced apart from each other to opposite sides of the center of the adjacent side of the base panel.

6. The device of claim 4, wherein the distal ends of the reinforcement stems of each set of reinforcement stems are in close proximity to the bottom edge of the anchoring flange cross arm adjacent thereto.

7. The device of claim 4, wherein the length of each of the reinforcement stems measured from its proximal end to its distal end is at least as long as the length of anchoring flanges measured from the proximal end of anchoring flange stem to the top edge of the anchoring flange cross arm.

8. A device for holding a container upright, the device when in a preassembled state, comprising:

a base panel having generally parallel first and second sides, and generally parallel third and fourth sides generally perpendicular to the first and second sides, upon which the bottom of the container to be held will rest;

a pair of Tee-shaped anchoring flanges, each Tee-shaped anchoring flange of the pair having a stem integrally connected at a proximal end of the stem to the base panel and a cross arm integral with and extending outwardly from a distal end of the stem, the Tee-shaped anchoring flanges being coplanar with the base panel with the cross-arms of the two anchoring flanges being adjacent to and extending along opposite first and second sides of the base panel and the stems of the two anchoring flanges extending inwardly of the base panel from the arm of the anchoring flanges;

a pair of panel reinforcement side flanges integrally connected and coplanar with the base panel, each panel reinforcement side flange of the pair being disposed at a different one of the third and fourth sides of the base panel; and two sets of reinforcement stems, each set of stems being integrally connected and coplanar with a different one of the pair of panel reinforcement side flanges.

9. The device of claim 8, wherein a first one of the sets of reinforcement side flanges is formed in the base panel by a fold line parallel to the third side of the panel, and a second one of the sets of reinforcement side flanges is formed in the base panel by a fold line parallel to the fourth side of the panel.

10. The device of claim 9, wherein one set of reinforcement side flange extends entirely along the third side of the base panel, and the other set of reinforcement side flanges extends entirely along the fourth side of the base panel.

11. The device of claim 9, wherein one set of reinforcement stems comprises a pair of stems each integrally connected at its proximal end to the first reinforcement side flange and extending along a portion of the length of the first reinforcement side flange, and the other set of reinforcement stems comprises a pair of stems each integrally connected at its proximal end to the second reinforcement side flange and extending along a portion of the length of the second reinforcement side flange.

12. The device of claim 11, wherein the proximal ends of the stems of each pair of reinforcement stems are adjacent to and spaced apart from each other.

13. The device of claim 12, further comprising a fold line at the integral connection of the proximal ends of the two stems of each pair of reinforcement stems to side reinforcement flange, the fold line extending between the proximal ends of the two stems.

14. A device for holding a container upright, the device when in a preassembled state, comprising:

a. a base panel upon which the bottom of the container to be held will rest;

b. a pair of anchoring flanges, each anchoring flange having a stem panel defined by a crease line formed in the base panel and extending entirely across the width of the base panel, the crease line being the proximal end of the anchoring flange, the proximal end of the stem being coextensive in width to the stem being coextensive in width to the width of the base panel; and c. a cross arm at the distal end of each of the stem panels, each cross arm being coextensive in length to the width of the base panel.

15. The device of claim 14, wherein the cross arm of each pair of anchoring flanges is integrally attached at its longitudinal center to the distal edge of the stem panel.

16. The device of claim 15, wherein the cross arm of the anchoring flange is adjacent to and extends along the distal edge of the stem panel.

17. The device of claim 16, wherein the cross arms of the two anchoring flanges are formed with a plurality of spaced-apart holes for receiving ties to fasten the cross arms of the two anchoring flanges together.

18. The device of claim 14, wherein the cross arm of each pair of anchoring flanges comprises a flexible strap attached to the distal edge of the stem panel.

19. The device of claim 17, wherein the cross arms comprise means for fastening the cross arms of the two anchoring flanges together.

20. The device of claim 18, wherein the fastening means of the cross arms comprise hook and eye fasteners.

* * * * *